US005426804A

United States Patent [19]

Wu

[11] Patent Number: 5,426,804

[45] Date of Patent: Jun. 27, 1995

[54] METHOD FOR MAKING A SHOE SOLE FROM GOURD FIBER

[76] Inventor: Jochen-For Wu, No. 197 Fu-De Rd., Hou-Li Town, Taichung County, Taiwan

[21] Appl. No.: 250,834

[22] Filed: May 31, 1994

[51] Int. Cl.[6] ..... A43B 10/00

[52] U.S. Cl. ..... 12/142 G; 12/146 B; 36/1

[58] Field of Search ..... 36/1, 84, 25 R, 25 A, 36/26, 30 A; 12/142 G, 146 B

[56] References Cited

U.S. PATENT DOCUMENTS

| | | | |
|---|---|---|---|
| 812,443 | 2/1906 | Wilde | 36/84 |
| 1,624,913 | 4/1927 | Ames | 36/32 A |

FOREIGN PATENT DOCUMENTS

| | | | |
|---|---|---|---|
| 390498 | 10/1908 | France | 36/25 A |
| 450076 | 3/1913 | France | 36/25 R |
| 563464 | 12/1923 | France | 36/84 |
| 290142 | 8/1914 | Germany | 36/25 A |
| 3946 | of 1878 | United Kingdom | 36/25 A |

*Primary Examiner*—Steven N. Meyers
*Attorney, Agent, or Firm*—Bacon & Thomas

[57] ABSTRACT

A shoe sole assembly is made by drying and cutting a fiber gourd into a cylindrical configuration. The cylindrical gourd fiber is then expanded and pressed into a sheet of gourd fiber. The sheet of gourd fiber may then be cut into a number of shoe soles. An insole layer may further be secured to each shoe sole to form the shoe sole assembly.

2 Claims, 5 Drawing Sheets

METHOD FOR MAKING A SHOE SOLE FROM GOURD FIBER

BACKGROUND OF THE INVENTION

1. Field of the Invention

The present invention relates to a method, and more particularly to a method for making a shoe sole material from gourd fibers.

2. Description of the Prior Art

Typical shoe soles are made of chemical materials, such as foamable materials, rubber materials, etc. The chemical materials may pollute our environment. In addition, ventilation is poor for the typical shoe sole of chemical materials.

The present invention has arisen to mitigate and/or obviate the afore-described disadvantages of the conventional shoe soles.

SUMMARY OF THE INVENTION

The primary objective of the present invention is to provide a method for making shoe sole from fibers of a gourd.

In accordance with one aspect of the invention, there is provided a method for making a shoe sole material from gourd fiber, the method comprising providing a gourd; drying the gourd into dried gourd fibers; cutting the dried gourd fibers into a cylindrical configuration; spreading the cylindrical gourd fibers into a sheet of gourd fibers; and cutting the sheet of gourd fibers into a plurality of shoe soles. An insole layer is further secured to the shoe soles so as to form a shoe sole assembly.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

A method in accordance with the present invention is provided for making shoe sole materials from staple or fiber of a gourd, such as a sponge or towel gourd, white gourd, spanish gourd or bottle gourd.

Figure 1:
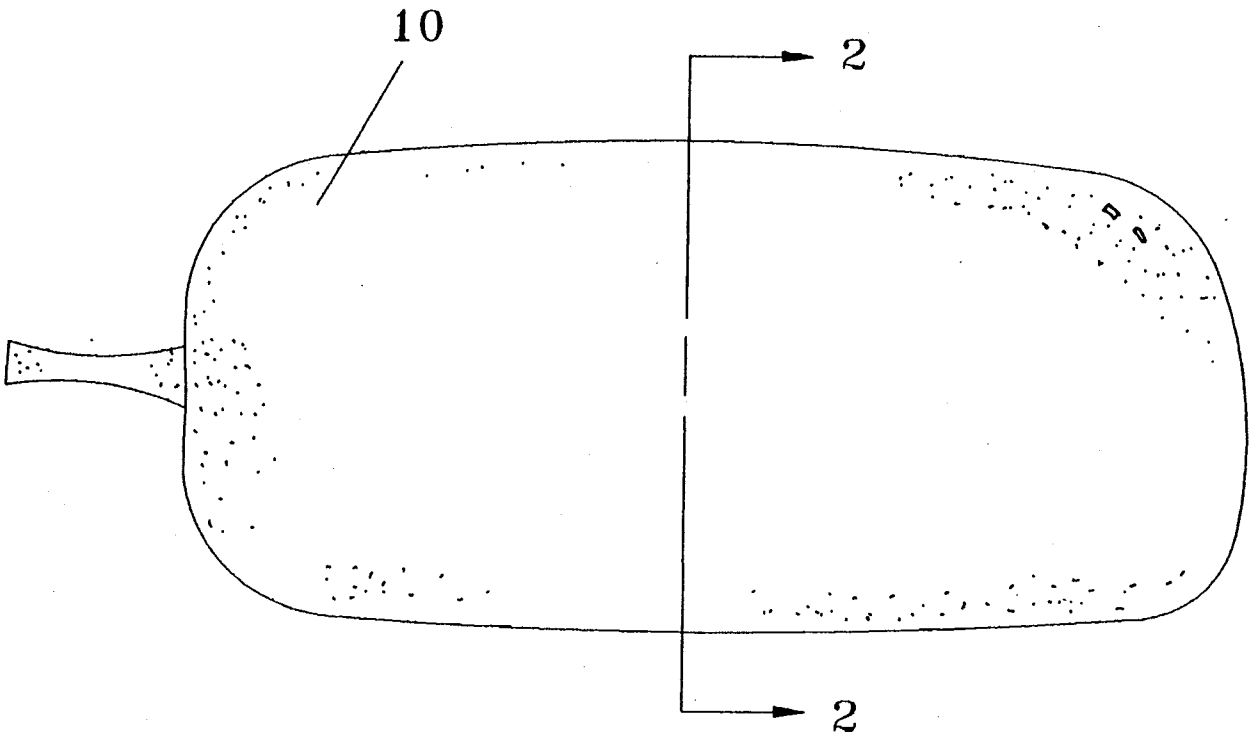
FIG. 1 is a plan view of a sponge or towel gourd to be made into shoe sole with the method in accordance with the present invention.
Figure 3:
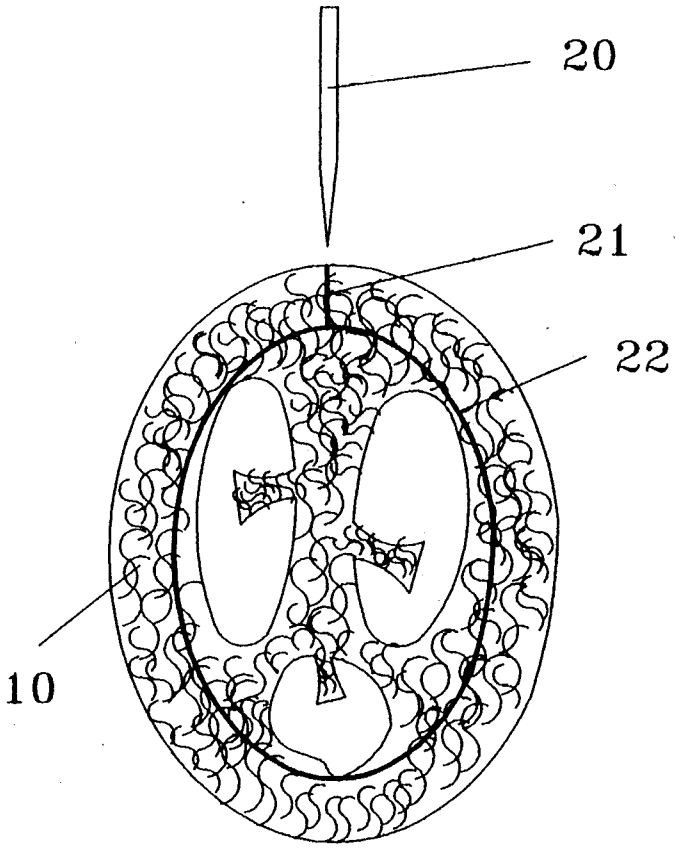
FIG. 3 is a cross sectional view similar to FIG. 2, illustrating the cutting operation of the method.
Figure 2:
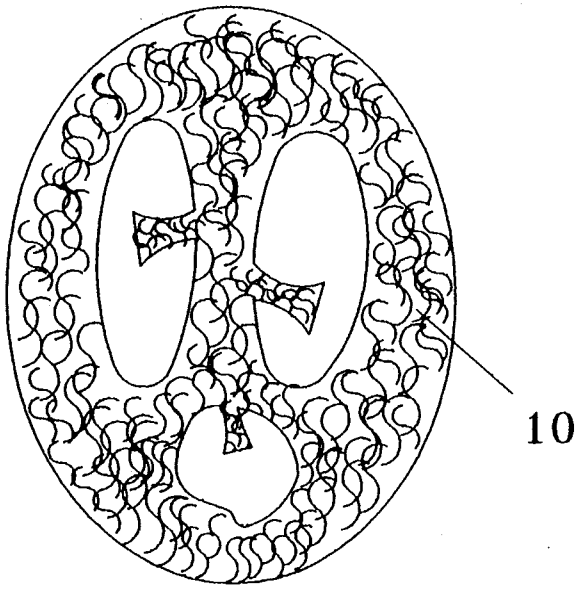
FIG. 2 is a cross sectional view taken along line 2—2 of FIG. 1.
Figure 4:
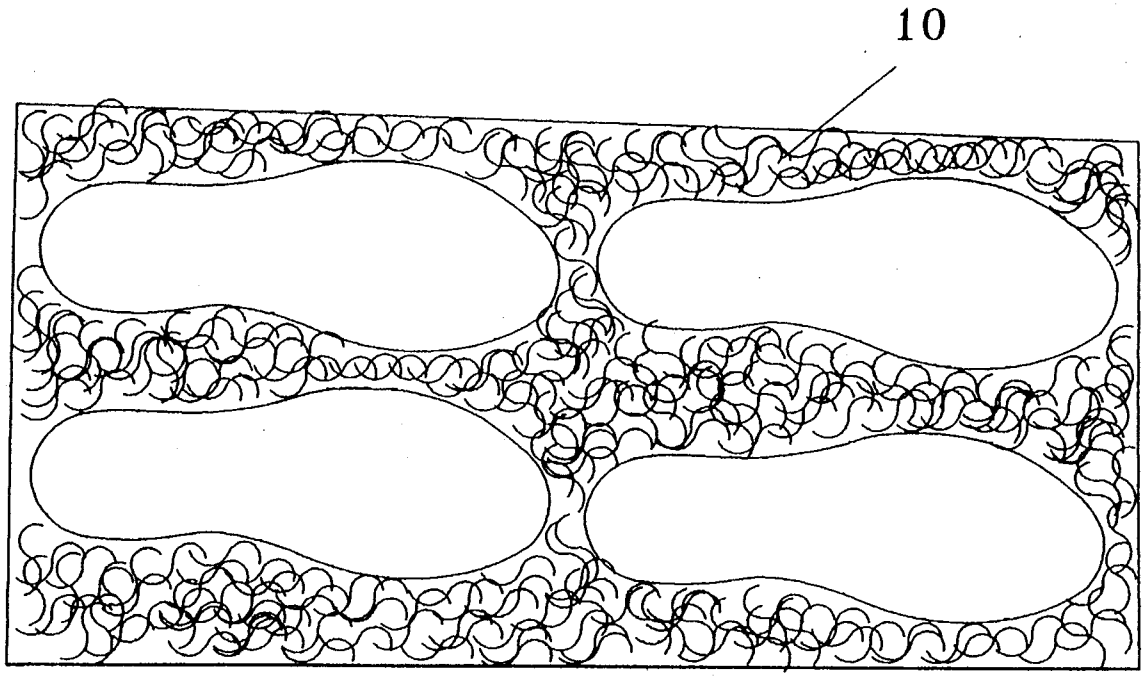
FIG. 4 is a plan view showing the spread gourd fiber.
Figure 5:
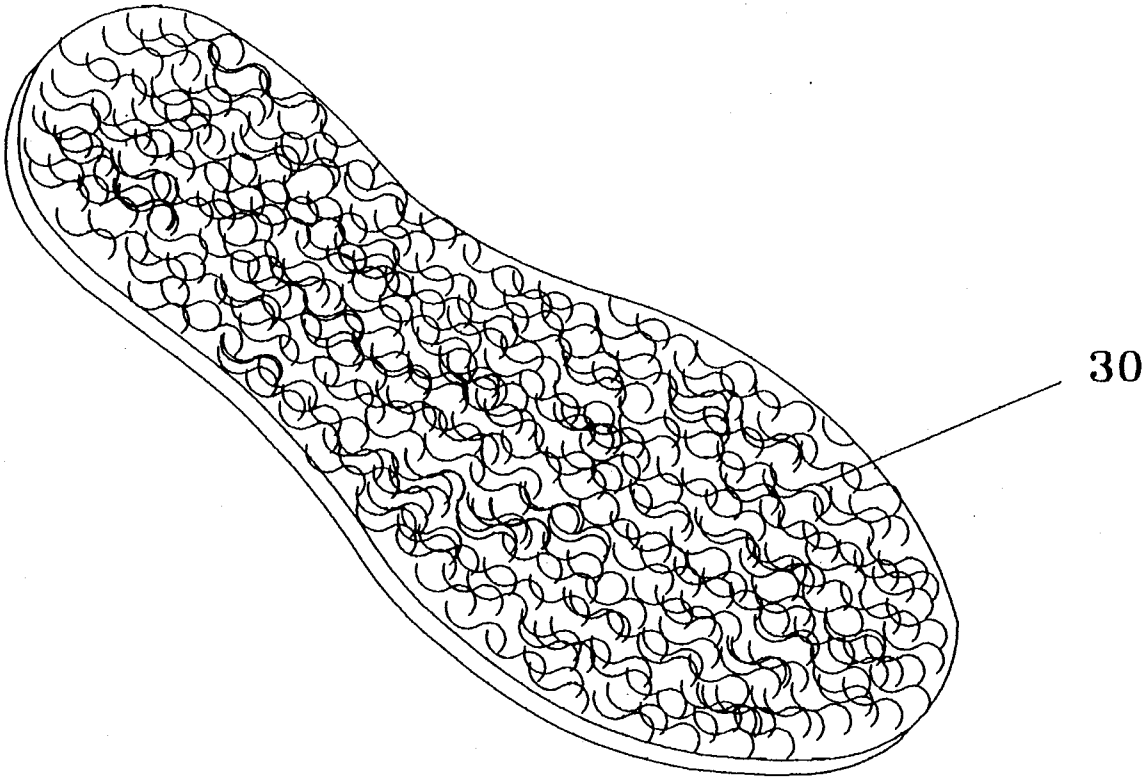
FIG. 5 is a perspective view of a shoe sole material cut from the gourd fiber as shown in FIG. 4.
Figure 6:
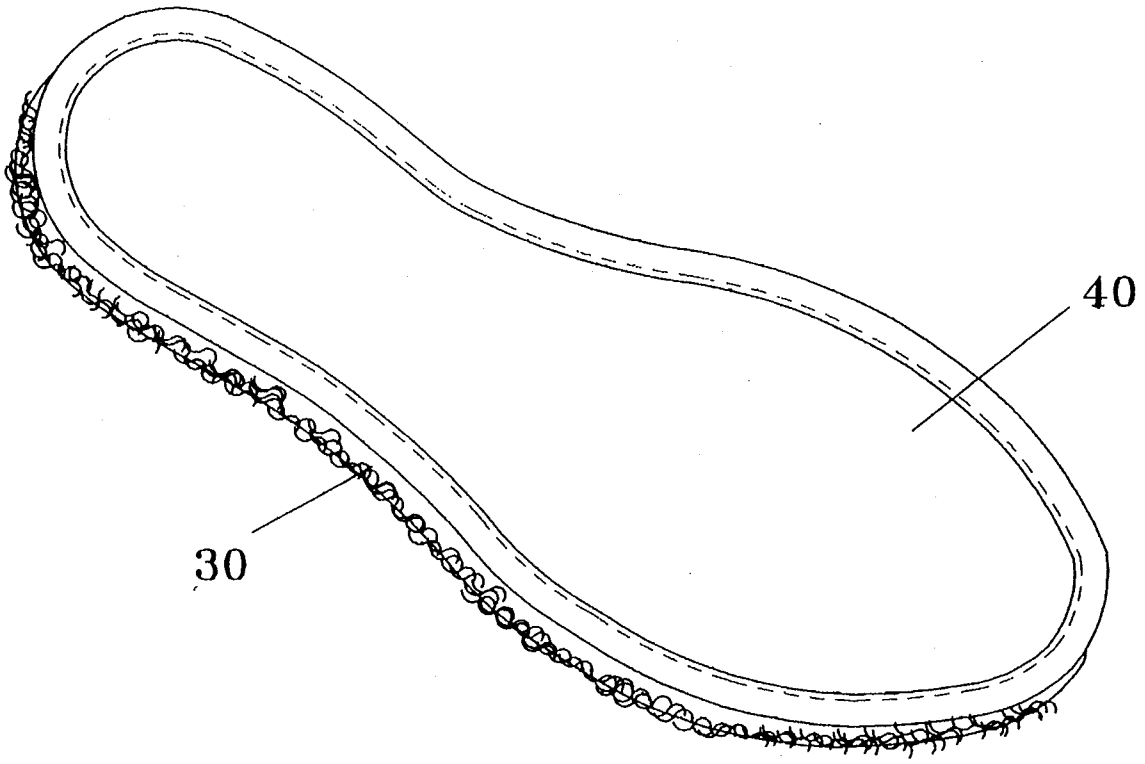
FIG. 6 is a perspective view of a shoe sole.

Referring to the drawings, and initially to FIGS. 1 and 2, illustrated therein is first provided a sponge or towel gourd 10. The gourd is dried into the gourd fiber as shown in FIG. 2. As shown in FIG. 3, a cutting element 20 cuts the gourd fiber 10 by slitting and coring along the lines 21, 22, respectively, so as to form a cylindrically shaped gourd fiber body. The cut gourd fiber body is then spread or expanded and pressed into a sheet of fiber material, as shown in FIG. 4. The fiber sheet is then cut or punched into a number of midsole members 30, as shown in FIG. 5. An insole layer 40 or a layer of woven cloth material is then secured to each midsole member 30 so as to form a shoe sole assembly, as shown in FIG. 6.

Accordingly, the method in accordance with the present invention may produce a shoe sole from gourd fiber which has excellent configuration for air ventilation purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A method of making a shoe sole from a gourd comprising the steps of:

a) providing a gourd formed of fibers;

b) drying the gourd;

c) cutting and coring the dried gourd into a fiber body of cylindrical configuration and having a slit longitudinally formed therein;

d) spreading the cylindrical fiber body into a sheet configuration; and e) cutting the sheet of fiber into a shoe sole formed of gourd fiber.

2. The method of claim 1 further including the step of:

a) securing an insole layer to the shoe sole of gourd fiber to form a shoe sole assembly.

* * * * *